US007902444B1

(12) United States Patent
Good et al.

(10) Patent No.: US 7,902,444 B1
(45) Date of Patent: Mar. 8, 2011

(54) MAGNETIC AND ADJUSTABLE THROW-OFF FOR SNARE DRUM

(75) Inventors: John J. Good, Thousand Oaks, CA (US); Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 12/592,208

(22) Filed: Nov. 20, 2009

(51) Int. Cl.
*G10D 13/02* (2006.01)

(52) U.S. Cl. ..... 84/411 R

(58) Field of Classification Search ..... 84/411 R, 84/413, 415–417, 411 A
See application file for complete search history.

(56) References Cited

U.S. PATENT DOCUMENTS

2006/0219084 A1* 10/2006 Dunnett ..... 84/415
2008/0264234 A1* 10/2008 Hsieh ..... 84/415

* cited by examiner

*Primary Examiner* — Kimberly R Lockett
(74) *Attorney, Agent, or Firm* — William W. Haefliger

(57) ABSTRACT

For combination with a snare drum having a side wall, a head, snare wiring extending adjacent the head, and a slidable band operatively connected with the snares, an assembly that comprises a mount connectible to said side wall, a support arm having operative adjustable connection to the mount, a handle operatively pivotally connected to the support arm, and also operatively connected to the band, the handle having an extended position in which the band is endwise loosened so that the snare wires are loosened, and also having a retracted position in which the band is endwise tightened so that the snare wires are tensioned adjacent the drum head.

12 Claims, 7 Drawing Sheets

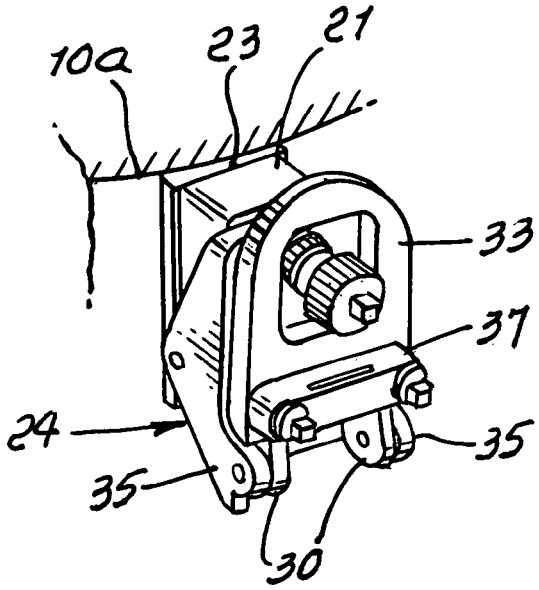
FIG. 2.
FIG. 3.
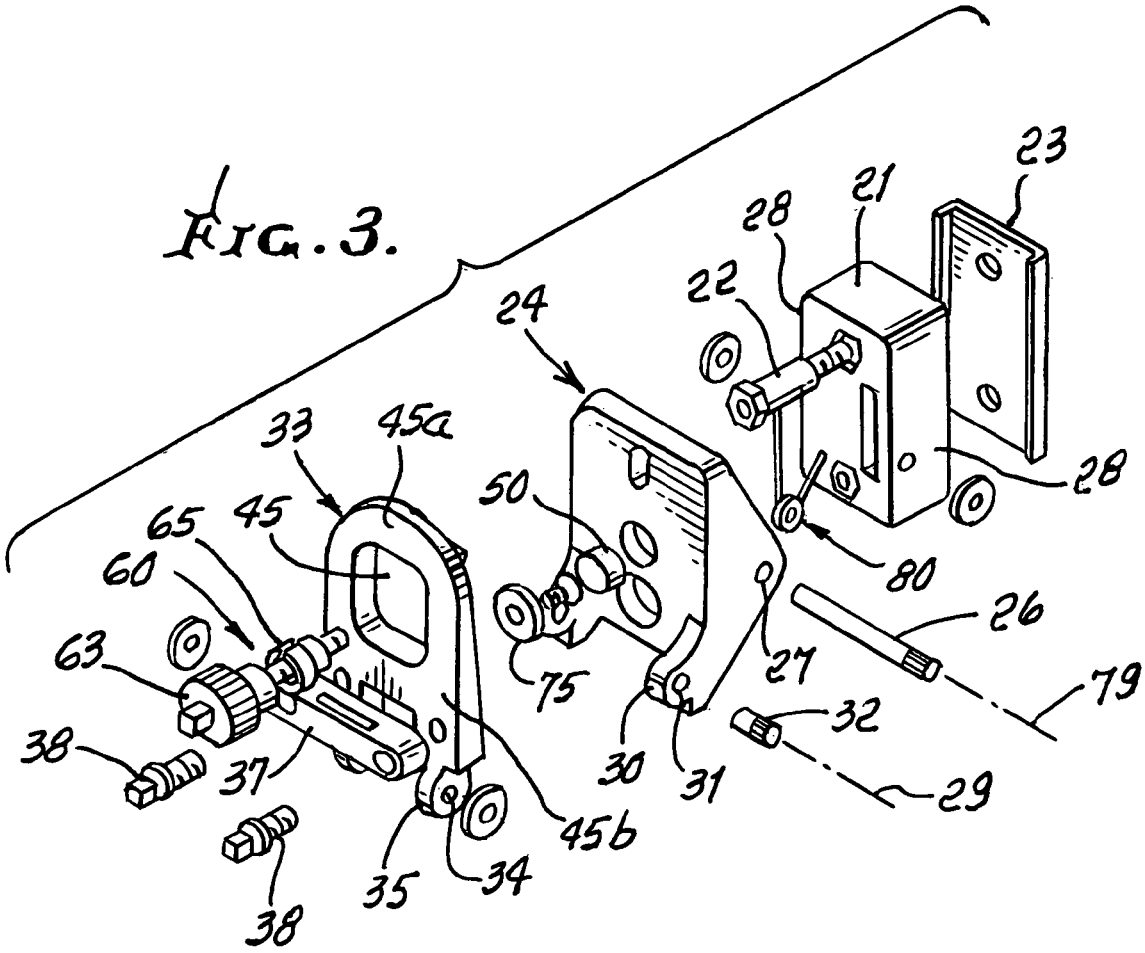

MAGNETIC AND ADJUSTABLE THROW-OFF FOR SNARE DRUM

BACKGROUND OF THE INVENTION

This invention relates generally to drumming apparatus, and more particularly to improvements to auxiliary apparatus attachable to a drum, such as a snare drum, in respect of tensioning and releasing of multiple strands that co-act with a drum head to produce desired acoustic effects.

U.S. Pat. No. 5,616,875 discloses apparatus of this general character. There is need for improvements in lever controlled tensioning and de-tensioning of the multiple strands as well as enabling lever captivation in strand tensioned condition, as are disclosed herein.

SUMMARY OF THE INVENTION

It is a major object of the invention to provide improved apparatus as referred to, for use in tensioning and de-tensioning drum snare wires, and wherein an endwise slidable tensioning band is employed. That apparatus basically comprises a) a mount connectible to a drum such as a snare drum side wall, b) a support arm having operative adjustable connection to the mount, c) a handle operatively pivotally connected to the support arm, and also operatively connected to the slidable band, the handle having an extended position in which the band is endwise loosened so that the snare wires are loosened, and also having a retracted position in which the band is endwise tightened so that the snare wires are tensioned adjacent the drum head.

As will be seen, the operative adjustable connection of the support arm to the mount typically comprises a pivoted connection allowing the support arm to be adjustably pivoted about a first axis which is parallel to a second axis defined by said handle pivoted connection to the support arm.

Another object is to provide a band connection to the handle at an adjusted location, there being provision for magnetic retention of the handle in retracted position, to retain tensioning of the band.

A further object is to provide a rotatable adjuster connected to at least one of the mount and support arm, to adjust the pivoted position of the support arm relative to the mount, whereby the pivoted positions of the handle in said retracted and extended positions is or are adjusted. The handle may be bifurcated to receive projected extent of the adjuster, said projected extent then being manually graspable to rotate the adjuster in handle retracted position. Also, the band may consist of low friction, synthetic resinous material.

The drum typically has an end ring extending about the head, the band having sliding engagement with the ring; the adjuster being located remotely from such slidable band.

These and other objects and advantages of the invention, as well as the details of an illustrative embodiment, will be more fully understood from the following specification and drawings, in which:

DRAWING DESCRIPTION

FIG. 2 is a perspective view of the FIG. 1 apparatus;

FIG. 3 is an exploded view of components of the apparatus;

DETAILED DESCRIPTION

Figure 1:
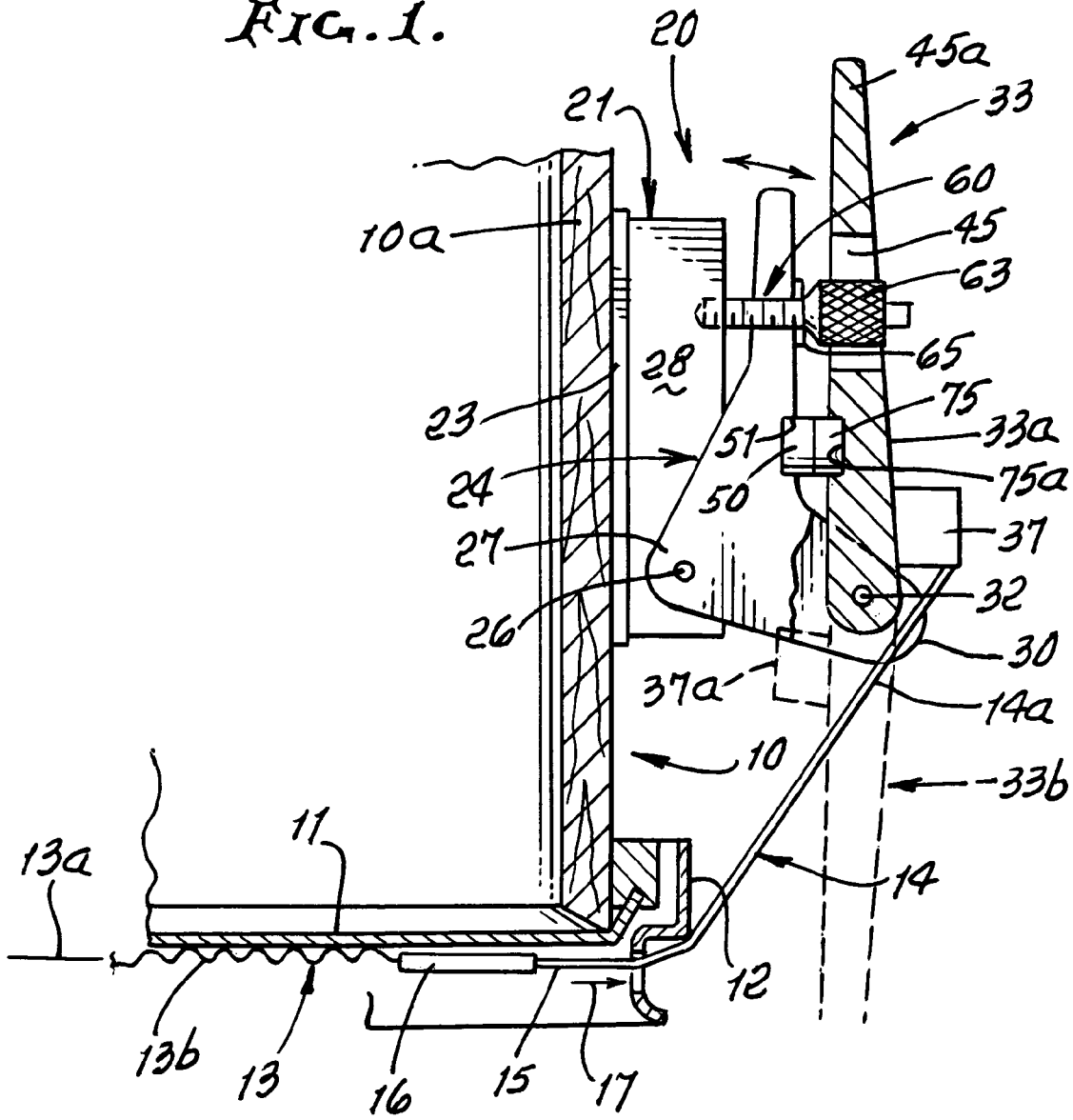
FIG. 1 is a schematic side view of apparatus incorporating a preferred form of the invention.
Figure 4:
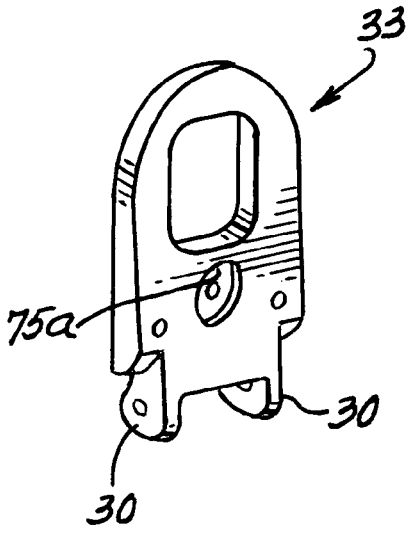
FIG. 4 is a perspective view of the apparatus handle.

Referring to FIGS. 1-3, a drum 10 has an annular side wall or shell 10*a* typically wooden, and a head 11 at one end of the shell, for example the lower end. A metallic ring 12 is provided to extend on and about the shell. A group 13 of snare wires 13*a* extends transversely across the head lower side, with snares 13*b* positioned to impact the head. A thin plastic tensioner band 14 is end connected at 15 to a fitting 16 to which the wires are endwise connected. That band extends toward and over the ring to slide endwise under force application, to tension the snare wires as the band is pulled in direction 17, and to loosen the wires as tensioning is released. Band 14 typically consists of low sliding friction, synthetic resinous material.

In accordance with the invention, an improved throw-off assembly 20 is provided at the side of the shell. It includes a mount or base 21 connectible to the side wall 10*a*, as by fasteners such as jackscrews 22. A gasket 23 may be provided to fit between the base and side wall.

Figure 14:
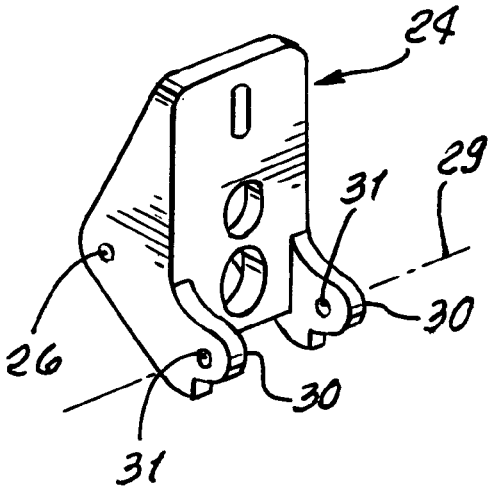
FIG. 14 is a perspective view of the support arm, as also seen in FIG. 1.
Figure 15:
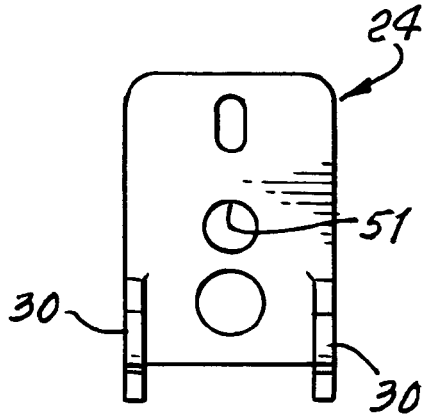
FIG. 15 is a frontal view of the FIG. 14 support arm.
Figure 16:
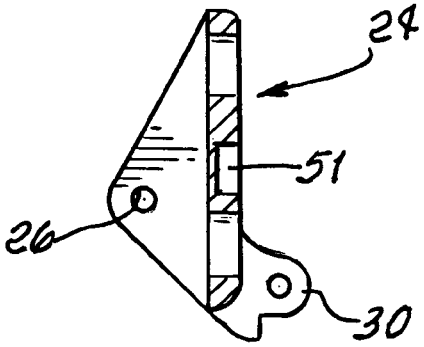
FIG. 16 is a left side view of the FIG. 15 arm.
Figure 17:
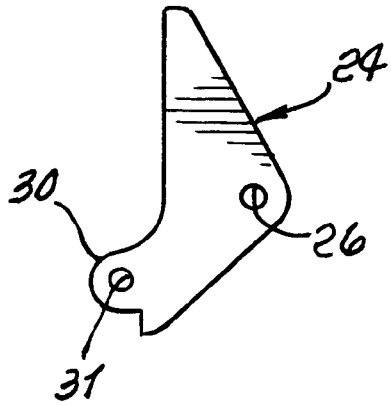
FIG. 17 is a right side view of the FIG. 15 arm.
Figure 18:
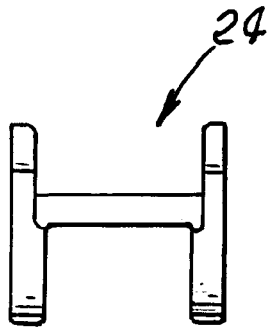
FIG. 18 is a bottom plan view of the FIG. 15 arm.
Figure 19:
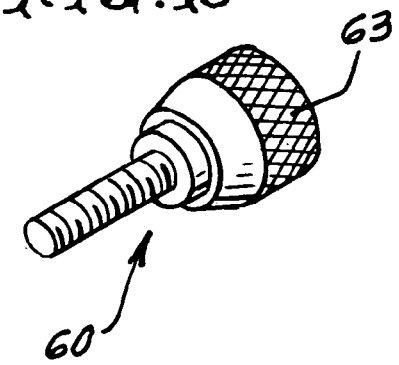
FIG. 19 is a perspective view of an adjuster having a manually rotatable throw-off knob.
Figure 24:
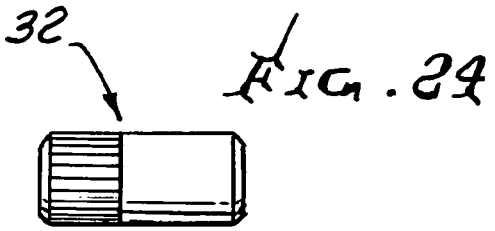
FIG. 24 is a side view of a small throw-off pin.
Figure 25:
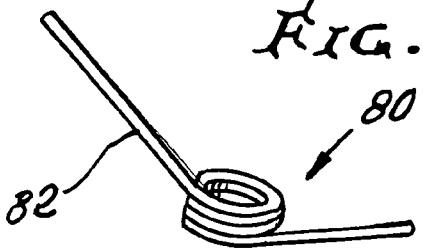
FIG. 25 is a perspective view of a throw-off torsion spring.
Figure 26:
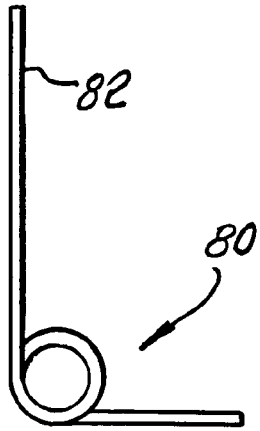
FIG. 26 is a side view of the FIG. 25 spring.
Figure 27:
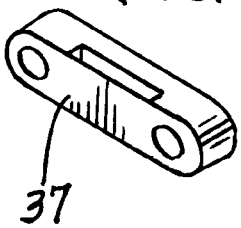
FIG. 27 is a perspective view of a throw-off strap plate.
Figure 28:
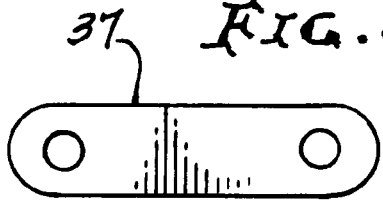
FIG. 28 is a frontal view of the FIG. 27 plate.
Figure 30:
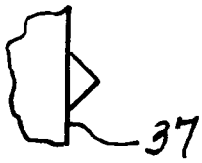
FIG. 30 is a section taken on lines 30-30 of FIG. 28.
Figure 29:
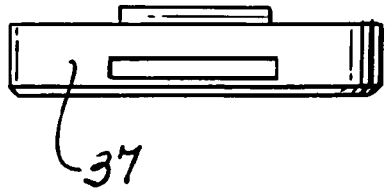
FIG. 29 is a top plan view of the FIG. 28 plate.

A support arm 24 such as a saddle is provided outwardly of the base, to be operatively connected with the base, as by a pin member, typically in the form of an elongated swivel pin 26 defining axis 79. That pin projects through saddle flanges 27 that project toward mount 21 and that straddle opposite sides 28 of the mount, whereby the saddle or arm can pivot relative to the saddle about a transverse axis 29 defined by pin 26. Arm 24 also has two projections 30 which are transversely spaced and define axially aligned holes or openings 31 that receive pivot pins 32. See FIGS. 3, 14 and 24. Axes 29 and 79 are parallel.

A throw-off handle 33 is operatively pivotally connected to the arm 24, as by pins 32 that also project through transversely aligned holes 34 in projections 35 at one end of the handle. The handle is also connected with, or connectible to, an end 14*a* of the band 14, as via a strap plate 37 projecting at the side 33*a* of the handle in a direction opposite the arm or saddle 24. Plate 37 is connected with the handle as by threaded fasteners 38, whereby the band position relative to the handle can be endwise adjusted, for adjusting snare engagement with the drum head.

The handle has a pivoted extended position, hanging as indicated at 33*b* in FIG. 1, in which the strap plate 37 is positioned at 37*a* relatively closer to the ring 12, whereby the band 14 is loosened relatively endwise so that the snare wires and snares are downwardly loosened relative to the drum head to hang downwardly away from that head. The handle also has an upwardly pivoted retracted position indicated at 33*b* in FIG. 1 in which the band 14 is tightened so that the snare wires are tensioned adjacent the drum head, in active play position.

Figure 5:
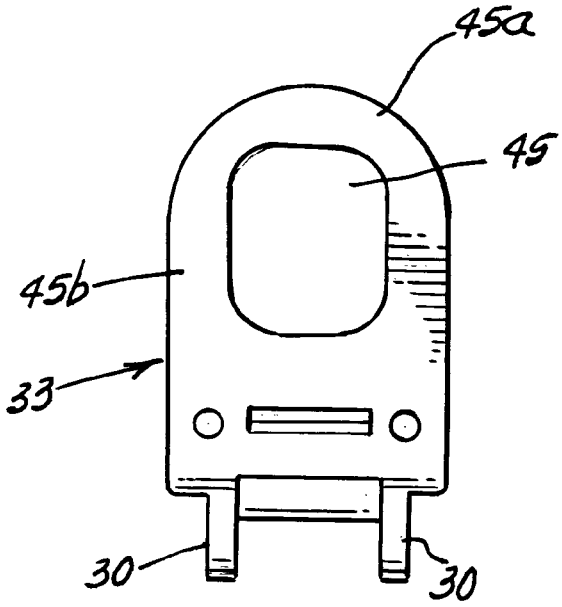
FIG. 5 is a frontal view of the handle.
Figure 6:
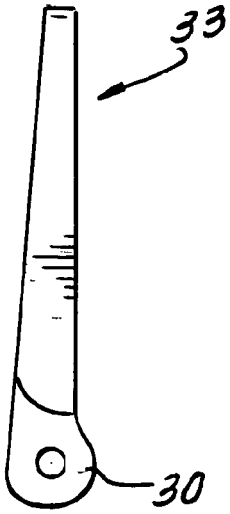
FIG. 6 is a left side view of the FIG. 5 handle.
Figure 7:
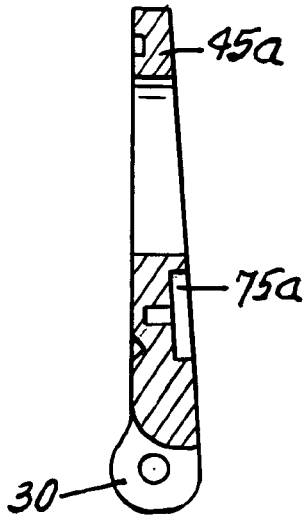
FIG. 7 is a right side view of the FIG. 5 handle.
Figure 8:
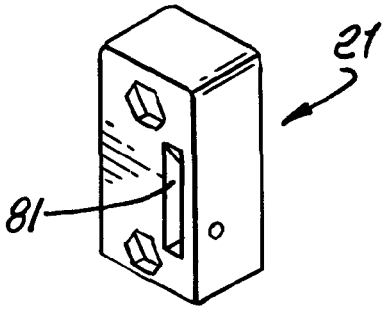
FIG. 8 is a perspective view of a mount connectable to the side of a snare drum.
Figure 13:
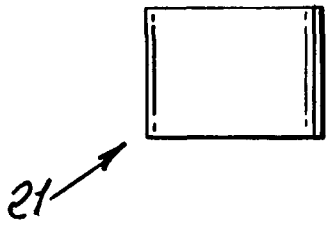
FIG. 13 is a top view of the FIG. 9 mount.
Figure 12:
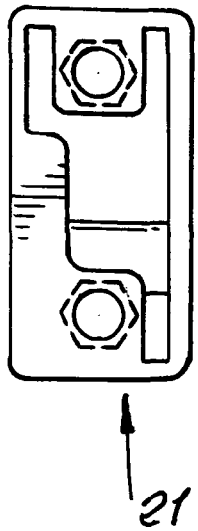
FIG. 12 is a rear view of the FIG. 9 mount.
Figure 10:
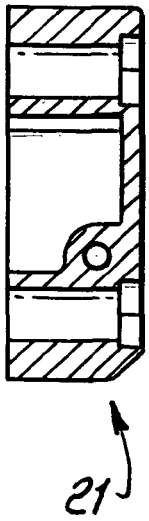
FIG. 10 is a left side view of the FIG. 9 mount.
Figure 9:
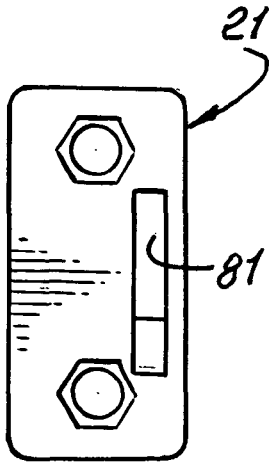
FIG. 9 is a frontal view of the FIG. 8 mount.
Figure 11:
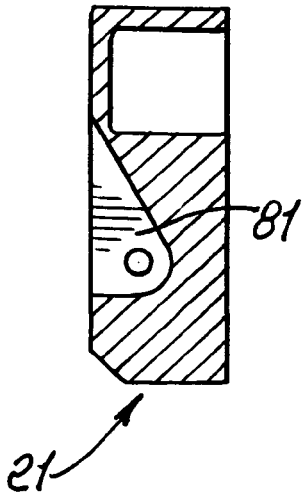
FIG. 11 is a right side view of the FIG. 9 mount.

For this purpose, the handle is typically bifurcated at 45, (see FIGS. 1, 3 and 5) to enable ease of manual grasping, as at handle bridge 45*a* connected with spaced legs 45*b*. A magnet 50, is fitted in opening 51 in arm 24, to register with and attract an insert steel disc 75 in the handle body portion recess 75*a* when the handle is swung to retracted position. Therefore, the handle is removably held in retracted position, to prevent inadvertent handle swinging to downwardly extended position, and loosening of the snares, from their drum playing position.

Figure 20:
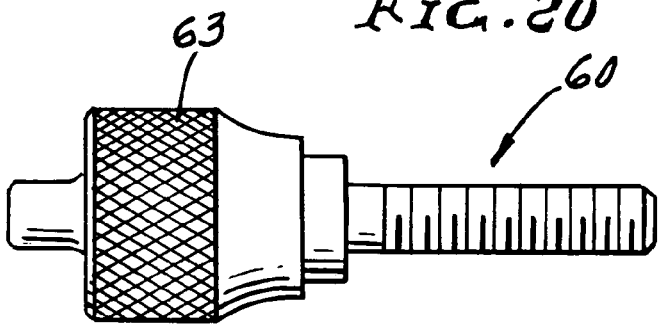
FIG. 20 is a side view of the FIG. 19 adjuster.
Figure 21:
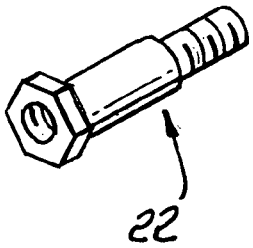
FIG. 21 is a perspective view of a throw-off receiver/jackscrew.
Figure 22:
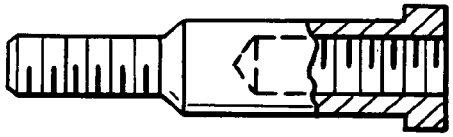
FIG. 22 is a side view of the jackscrew of FIG. 21.
Figure 23:
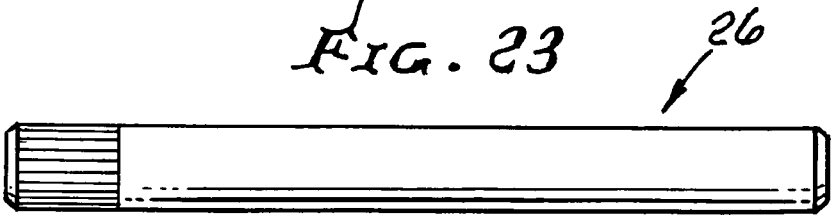
FIG. 23 is a side view of a large throw-off pin.

Also provided is an adjuster 60 (see FIGS. 3 and 20) rotatably connected to the mount 21 and support arm 24, to adjust the pivoted position of the support arm relative to the mount, whereby the pivoted position of the handle in said retracted and extended positions is adjusted, for fine tuning of the snare positions relative to the drum head. The adjuster is shown in the form of a fastener projecting through the opening 45 formed by the handle bifurcation and may also be connected to the top of the receiver base 21. Opening 45 is sufficiently large as to enable user finger access to and manual rotatable adjustment of the adjuster knob 63, partially received in opening 45, and also to accommodate handle swinging between retracted and extended positions, without interference with the adjuster. A pressure insert, such as a rubber washer 65 on the adjuster is compressed between 63 and 24 to prevent axial looseness of the connection between the arm and mount, during rotatable and rotated adjustment of the adjuster. A torsion spring 80 fits in an elongated recess 81 in the mount 21. Spring leg 82 projects from the recess and bears against arm 24 to bias it and the magnet toward the handle and steel disc, in FIG. 1. This assures magnetic attraction of the handle in all tilt positions of the arm 24.

FIGS. 4-30 show detailed constructions and configurations of the above numbered elements, which provide unusual advantages in their operation and results, in terms of ease and accuracy of band adjustment and positioning.

The handle, arm and mount elements may consist of molded plastic material.

We claim:

1. For combination with a snare drum having a side wall, a head, snare wiring extending adjacent the head, and a band element which is elongated and slidable and operatively connected with the snares, an assembly that comprises:

a) a mount connectible to said side wall, b) a support arm having operative adjustable connection to said mount, c) a handle operatively pivotally connected to said support arm, and also operatively connected to said band element, the handle having an extended position in which the element is endwise loosened so that the snare wires are loosened, and also having a retracted position in which the element is endwise tightened so that the snare wires are tensioned adjacent the drum head, d) and including said drum and band element in combination with the assembly, the drum having an end ring extending about the head, the band element having sliding engagement with the ring.

2. The assembly of claim 1 wherein said operative adjustable connection of the support arm to the mount is a pivoted connection allowing the support arm to be adjustably pivoted about a first axis which is parallel to a second axis defined by said handle pivoted connection to the support arm.

3. The assembly of claim 1 wherein the element is connected to said handle at a location which is bodily displaced as the handle is moved between said extended and retracted positions.

4. The assembly of claim 1 including an adjuster rotatably connected to at least one of the mount and support arm, to adjust the pivoted position of the support arm relative to the mount, whereby the pivoted positions of the handle in said retracted and extended positions is adjusted.

5. For combination with a snare drum having a side wall, a head, snare wiring extending adjacent the head, and a band element which is elongated and slidable and operatively connected with the snares, an assembly that comprises:

a) a mount connectible to said side wall, b) a support arm having operative adjustable connection to said mount, c) a handle operatively pivotally connected to said support arm, and also operatively connected to said band element, the handle having an extended position in which the element is endwise loosened so that the snare wires are loosened, and also having a retracted position in which the element is endwise tightened so that the snare wires are tensioned adjacent the drum head, d) there being an adjuster rotatably connected to at least one of the mount and support arm, to adjust the pivoted position of the support arm relative to the mount, whereby the pivoted positions of the handle in said retracted and extended positions is adjusted, e) and wherein the handle is bifurcated to receive projected extent of the adjuster, said projected extent then being manually graspable to rotate the adjuster.

6. The assembly of claim 3 wherein said location of element connection to the handle is at a side of the handle facing away from the mount.

7. For combination with a snare drum having a side wall, a head, snare wiring extending adjacent the head, and a band element which is elongated and slidable and operatively connected with the snares, an assembly that comprises:

a) a mount connectible to said side wall, b) a support arm having operative adjustable connection to said mount, c) a handle operatively pivotally connected to said support arm, and also operatively connected to said band element, the handle having an extended position in which the element is endwise loosened so that the snare wires are loosened, and also having a retracted position in which the element is endwise tightened so that the snare wires are tensioned adjacent the drum head, d) wherein said band element element consists of low friction, synthetic resinous material.

8. The assembly of claim 5 including said drum and element in combination with the assembly, the drum having an end ring extending about the head, the element having sliding engagement with the ring, said adjuster located remotely from the element and ring.

9. For combination with a snare drum having a side wall, a head, snare wiring extending adjacent the head, and a band element which is elongated and slidable and operatively connected with the snares, an assembly that comprises:

a) a mount connectible to said side wall, b) a support arm having operative adjustable connection to said mount, c) a handle operatively pivotally connected to said support arm, and also operatively connected to said band element, the handle having an extended position in which the element is endwise loosened so that the snare wires are loosened, and also having a retracted position in which the element is endwise tightened so that the snare wires are tensioned adjacent the drum head, d) including a magnet element and a steel insert element, one of the magnet and insert elements carried by the handle and the other of the magnet and insert elements carried by said arm, said magnet and insert elements mutually registering in handle retracted position, to provide magnetic force operating to hold the handle against inadvertent dislodgement from handle retracted position, whereby snares are not then inadvertently loosened.

10. The assembly of claim 9 including a torsion spring carried by the mount and having a spring leg biasing the arm and toward the handle, to position said insert and magnet elements toward effective magnetically mutually attracting positions, in all tilted positions of the arm.

11. For combination with a snare drum having a side wall, a head, snare wiring extending adjacent the head, and a band element which is elongated and slidable and operatively connected with the snares, an assembly that comprises:

a) a mount connectible to said side wall, b) a support arm having operative adjustable connection to said mount, c) a handle operatively pivotally connected to said support arm, and also operatively connected to said band element, the handle having an extended position in which the element is endwise loosened so that the snare wires are loosened, and also having a retracted position in which the element is endwise tightened so that the snare wires are tensioned adjacent the drum head, d) wherein the handle, arm and mount elements consist of molded plastic material, or aluminum, or steel.

12. The assembly of claim 1 wherein said element comprises one of the following:

i) band ii) wire iii) string iv) strap.

* * * * *